US006973194B2

(12) United States Patent
Iwasa et al.

(10) Patent No.: US 6,973,194 B2
(45) **Date of Patent: *Dec. 6, 2005**

(54) SPEAKER

(75) Inventors: Mikio Iwasa, Osaka (JP); Hiroyuki Takewa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/760,893

(22) Filed: Jan. 20, 2004

(65) Prior Publication Data

US 2004/0146174 A1 Jul. 29, 2004

Related U.S. Application Data

(62) Division of application No. 10/145,434, filed on May 13, 2002, now Pat. No. 6,714,655.

(30) Foreign Application Priority Data

May 11, 2001 (JP) ..... 2001-141210

(51) Int. Cl.[7] ..... H04R 25/00

(52) U.S. Cl. ..... 381/412; 381/407; 381/423; 381/431; 381/401

(58) Field of Search ..... 381/386, 396, 381/401–405, 407, 412, 419, 423, 430–431, 381/433, 399

(56) References Cited

U.S. PATENT DOCUMENTS

| | | | | |
|---|---|---|---|---|
| 4,584,439 | A | 4/1986 | Paddock | |
| 6,526,151 | B1 | 2/2003 | Peng | |
| 6,681,026 | B2 * | 1/2004 | Kam | 381/412 |
| 6,714,655 | B2 * | 3/2004 | Iwasa et al. | 381/396 |

FOREIGN PATENT DOCUMENTS

| | | |
|---|---|---|
| JP | 10-191494 | 7/1998 |

* cited by examiner

*Primary Examiner*—Sinh Tran
*Assistant Examiner*—Phylesha Dabney
(74) *Attorney, Agent, or Firm*—RatnerPrestia

(57) ABSTRACT

A speaker includes: a frame; a magnetic circuit fixed to the frame; a diaphragm fixed to the frame so as to be capable of vibrating in a predetermined direction; a driving force transmitting member connected to the diaphragm; and a damper for supporting the driving force transmitting member, wherein the magnetic circuit is positioned between a first plane and a second plane, the first plane being parallel to the diaphragm and defined as a plane with which at least a portion of the magnetic circuit is in contact, and the second plane being parallel to the diaphragm and defined as a plane with which at least a portion of the magnetic circuit is in contact, and one end of the damper is connected at a position between the first and second planes, and the other end of the damper is connected at another position between the first and second planes.

3 Claims, 16 Drawing Sheets

SPEAKER

This application is a Divisional of U.S. patent application Ser. No. 10/145,434, filed May 13, 2002 now U.S. Pat. No. 6,714,655.

BACKGROUND OF THE INVENTION

The entire disclosure of U.S. patent application Ser. No. 10/145,434, filed May 13, 2002, is expressly incorporated by reference herein.

1. Field of the Invention

The present invention relates to a speaker.

2. Description of the Related Art

When a speaker(s) is installed in a personal computer or multimedia portable apparatus, for example, it is usual for a pair of speakers to be installed in elongated areas at right and left sides of a video screen of the personal computer or multimedia portable apparatus, or for a single speaker to be installed in another elongated area under the video screen. Thus, it is desirable that the shape of such a speaker be an elongated shape, such as a rectangular shape, an elliptic shape, or the like.

For example, a conventional speaker 1200 is described in Japanese Laid-Open Publication No. 10-191494. Hereinafter, the conventional speaker 1200 is described with reference to FIGS. 12*a* and 12*b*.

FIG. 12*a* is a plan view of the conventional speaker 1200. FIG. 12*b* is a cross-sectional view of the conventional speaker 1200 taken along line 12*b*—12*b* of FIG. 12*a*.

The speaker 1200 includes: a frame 1201; a magnetic circuit 1206 fixed to the frame 1201: a diaphragm 1203, which is fixed to the frame 1201 such that the diaphragm 1203 can vibrate in a direction shown by arrow P of FIG. 12*b*; a driving force transmitting member 1204 connected to the diaphragm 1203; and dampers 1205 for supporting the driving force transmitting member 1204. An outer perimeter of the diaphragm 1203 is fixed to the frame 1201 via an edge 1202.

One end of each damper 1205 is connected to the driving force transmitting member 1204 above the magnetic circuit 1206. The other end of each damper 1205 is connected to the frame 1201 above the magnetic circuit 1206.

The driving force transmitting member 1204 has a region wherein a voice coil 1207 is formed. When a driving current flows through the voice coil 1207, a driving force is produced in a direction shown by arrow P of FIG. 12*b* due to an effect produced by the driving current and a magnetic flux supplied by the magnetic circuit 1206. The driving force transmitting member 1204 is configured such that the produced driving force is transmitted to the diaphragm 1203. This transmitted driving force causes the diaphragm 1203 to vibrate in the direction shown by arrow P. As a result, sound is reproduced.

However, the thickness of the conventional speaker 1200 amounts to at least the sum of the thickness of the magnetic circuit 1206, the thickness of the damper 1205, and the thickness of the diaphragm 1203. This is because the damper(s) 1205 is provided above the magnetic circuit 1206.

SUMMARY OF THE INVENTION

According to one aspect of the present invention, a speaker includes: a frame; a magnetic circuit fixed to the frame; a diaphragm fixed to the frame so as to be capable of vibrating in a predetermined direction; a driving force transmitting member connected to the diaphragm; and a damper for supporting the driving force transmitting member, wherein the magnetic circuit is positioned between a first plane and a second plane, the first plane being parallel to the diaphragm and defined as a plane with which at least a portion of the magnetic circuit is in contact, and the second plane being parallel to the diaphragm and defined as a plane with which at least a portion of the magnetic circuit is in contact, the driving force transmitting member has a region in which a voice coil is formed, the driving force transmitting member is structured so as to transmit to the diaphragm, a driving force, in the predetermined direction, caused by an effect of an electric current flowing through the voice coil and a magnetic flux generated from the magnetic circuit, and one end of the damper is connected at a position between the first and second planes, and the other end of the damper is connected at another position between the first and second planes.

In one embodiment of the present invention, the magnetic circuit is positioned inside the frame.

In another embodiment of the present invention, the diaphragm has a recessed portion, and the driving force transmitting member is connected to the recessed portion of the diaphragm.

In still another embodiment of the present invention, the frame has a recessed portion, and at least a portion of the magnetic circuit is buried in the recessed portion of the frame.

In still another embodiment of the present invention, the magnetic circuit has a protrusion, and the frame has a portion which connects to the protrusion.

In still another embodiment of the present invention, the magnetic circuit includes a first magnetic circuit portion and a second magnetic circuit portion; the frame includes a first frame plate to which the first magnetic circuit portion is connected, a second frame plate to which the second magnetic circuit portion is connected, a third frame plate, and a fourth frame plate: an end side of the third frame plate is connected to an end side of the first frame plate, and the other end side of the third frame plate is connected to an end side of the second frame plate; and an end side of the fourth frame plate is connected to the other end side of the first frame plate, and the other end side of the fourth frame plate is connected to the other end side of the second frame plate.

In still another embodiment of the present invention, the frame further includes a bottom plate.

In still another embodiment of the present invention, the driving force transmitting member includes at least one through hole outside of a region in which the voice coil is formed.

In still another embodiment of the present invention, the driving force transmitting member is formed by combining a core member having at least one through hole and a surface member having a region in which the voice coil is formed.

In still another embodiment of the present invention, the magnetic circuit includes a first magnetic circuit portion, a second magnetic circuit portion, and a magnetic gap defined by the first and second magnetic circuit portions; the first magnetic circuit portion includes a first magnet having a rectangular parallelepiped shape, a first plate fixed onto an upper surface of the first magnet, and a second plate fixed onto a lower surface of the first magnet; the second magnetic circuit portion includes a second magnet having a rectangular parallelepiped shape, a third plate fixed onto an upper surface of the second magnet and a fourth plate fixed onto a lower surface of the second magnet; a side surface of the first magnetic circuit portion is connected onto the frame, a side surface of the second magnetic circuit portion is connected onto the frame, the first and second magnets face each other such that facing sides thereof have opposite polarities; the magnetic gap includes a first magnetic gap, which is defined by the first and third plates and through which the magnetic flux generated by the first and second magnets passes, and a second magnetic gap, which is defined by the second and fourth plates and through which the magnetic flux generated by the first and second magnets passes.

In still another embodiment of the present invention, the magnetic circuit includes a first magnetic circuit portion, a second magnetic circuit portion, and a magnetic gap defined by the first and second magnetic circuit portions; the first magnetic circuit portion includes a magnet having a rectangular parallelepiped shape, a first plate fixed onto an upper surface of the magnet, and a second plate fixed onto a lower surface of the magnet; the second magnetic circuit portion includes a yoke; a side surface of the first magnetic circuit portion is connected onto the frame, a side surface of the second magnetic circuit portion is connected onto the frame, the magnet and the yoke face each other; the magnetic gap includes a first magnetic gap, which is defined by the first plate and the yoke and through which the magnetic flux generated by the magnet passes, and a second magnetic gap, which is defined by the second plate and the yoke and through which the magnetic flux generated by the magnet passes.

In still another embodiment of the present invention, at least a portion of the first plate is in contact with the yoke which faces the first plate, and at least a portion of the second plate is in contact with the yoke which faces the second plate.

In still another embodiment of the present invention, the magnetic circuit includes a first magnetic circuit portion, a second magnetic circuit portion, and a magnetic gap defined by the first and second magnetic circuit portions: the first magnetic circuit portion includes a first magnet having a rectangular parallelepiped shape, a second magnet having a rectangular parallelepiped shape, a first plate, and a second plate: the second magnetic circuit portion includes a yoke; a side surface of the first plate is connected onto the frame, the opposite side surface of the first plate is connected onto the first magnet, a side surface of the second plate is connected onto the frame, the opposite side surface of the second plate is connected onto the second magnet, the first magnet and the yoke face each other, and the second magnet and the yoke face each other; the first and second magnets are aligned along a predetermined direction such that facing sides thereof have opposite polarities; and the magnetic gap includes a first magnetic gap, which is defined by the first plate and the yoke and through which the magnetic flux generated by the first magnet passes, and a second magnetic gap, which is defined by the second plate and the yoke and through which the magnetic flux generated by the second magnet passes.

In still another embodiment of the present invention, a speaker includes: a frame; a magnetic circuit fixed to the frame; a diaphragm fixed to the frame so as to be capable of vibrating in a predetermined direction: a driving force transmitting member connected to the diaphragm; and a damper for supporting the driving force transmitting member, wherein the magnetic circuit is positioned between a first plane and a second plane, the first plane being parallel to the diaphragm and defined as a plane with which at least a portion of the magnetic circuit is in contact, and the second plane being parallel to the diaphragm and defined as a plane with which at least a portion of the magnetic circuit is in contact, the driving force transmitting member has a region in which a voice coil is formed, the driving force transmitting member is structured so as to transmit to the diaphragm, a driving force, in the predetermined direction, caused by an effect of an electric current flowing through the voice coil and a magnetic flux generated from the magnetic circuit, the magnetic circuit includes a first magnetic circuit portion, a second magnetic circuit portion, and a magnetic gap defined by the first and second magnetic circuit portions, the first magnetic circuit portion includes a magnet having a rectangular parallelepiped shape, a first plate fixed onto an upper surface of the magnet, and a second plate fixed onto a lower surface of the magnet, the second magnetic circuit portion includes a yoke, a side surface of the first magnetic circuit portion is connected onto the frame, a side surface of the second magnetic circuit portion is connected onto the frame, the magnet and the yoke face each other, and the magnetic gap includes a first magnetic gap, which is defined by the first plate and the yoke and through which the magnetic flux generated by the magnet passes, and a second magnetic gap, which is defined by the second plate and the yoke and through which the magnetic flux generated by the magnet passes.

In one embodiment of the present invention, at least a portion of the first plate is in contact with the yoke which faces the first plate, and at least a portion of the second plate is in contact with the yoke which faces the second plate.

In still another embodiment of the present invention, a speaker includes: a frame: a magnetic circuit fixed to the frame; a diaphragm fixed to the frame so as to be capable of vibrating in a predetermined direction; a driving force transmitting member connected to the diaphragm; and a damper for supporting the driving force transmitting member, wherein the magnetic circuit is positioned between a first plane and a second plane, the first plane being parallel to the diaphragm and defined as a plane with which at least a portion of the magnetic circuit is in contact, and the second plane being parallel to the diaphragm and defined as a plane with which at least a portion of the magnetic circuit is in contact, the driving force transmitting member has a region in which a voice coil is formed, the driving force transmitting member is structured so as to transmit to the diaphragm, a driving force, in the predetermined direction, caused by an effect of an electric current flowing through the voice coil and a magnetic flux generated from the magnetic circuit, the magnetic circuit includes a first magnetic circuit portion, a second magnetic circuit portion, and a magnetic gap defined by the first and second magnetic circuit portions, the first magnetic circuit portion includes a first magnet having a rectangular parallelepiped shape, a second magnet having a rectangular parallelepiped shape, a first plate, and a second plate, the second magnetic circuit portion includes a yoke, a side surface of the first plate is connected onto the frame, the opposite side surface of the first plate is connected onto the first magnet, a side surface of the second plate is connected onto the frame, the opposite side surface of the second plate is connected onto the second magnet, the first magnet and the yoke face each other, and the second magnet and the yoke face each other, the first and second magnets are aligned along a predetermined direction such that facing sides thereof have opposite polarities, and the magnetic gap includes a first magnetic gap, which is defined by the first plate and the yoke and through which the magnetic flux generated by the first magnet passes, and a second magnetic gap, which is defined by the second plate and the yoke and through which the magnetic flux generated by the second magnet passes.

Thus, the invention described herein makes possible the advantage of: (1) providing a speaker which is thinner, by at least the thickness of the damper, than a conventional speaker which has the damper above a magnetic circuit; and (2) providing a magnetic circuit which further improves the driving efficiency of a speaker.

This and other advantages of the present invention will become apparent to those skilled in the art upon reading and understanding the following detailed description with reference to the accompanying figures.

DESCRIPTION OF THE PREFERRED EMBODIMENTS

Hereinafter, embodiments of the present invention will be described with reference to the drawings.

1. Structure of a Speaker of the Present Invention

Figure 1A:
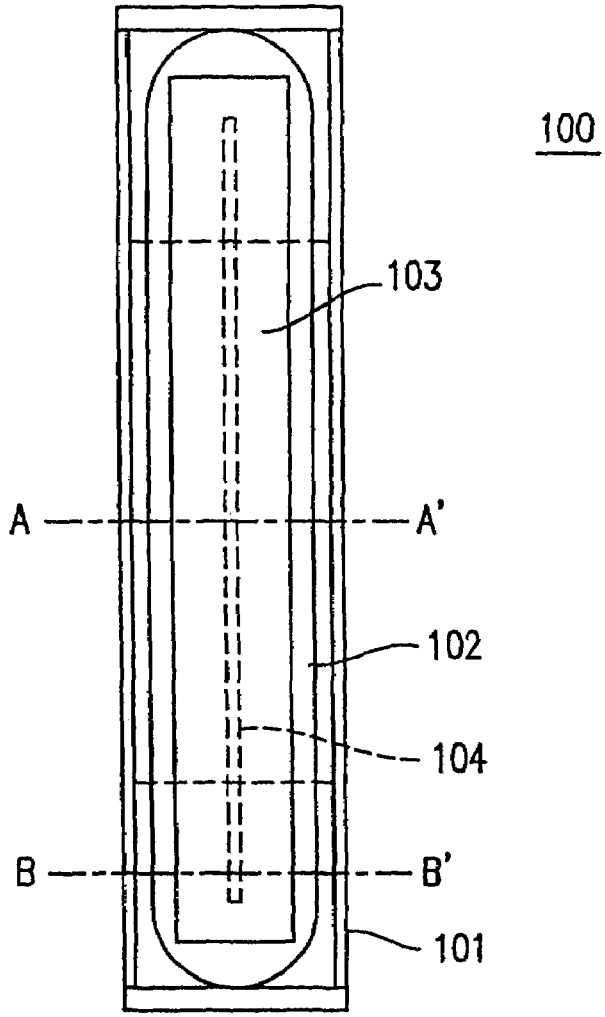
FIG. 1*a* is a plan view of a speaker 100 according to an embodiment of the present invention.
Figure 1B:
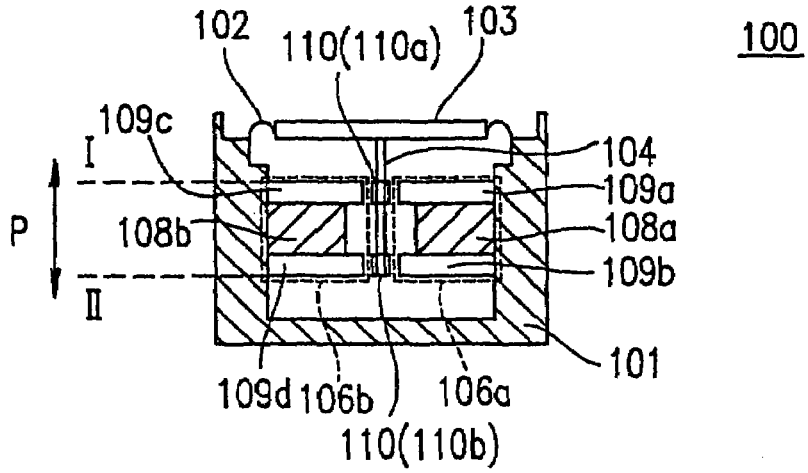
FIG. 1*b* is a cross-sectional view of the speaker 100 taken along line 1*b*—1*b* of FIG. 1*a*.
Figure 1C:
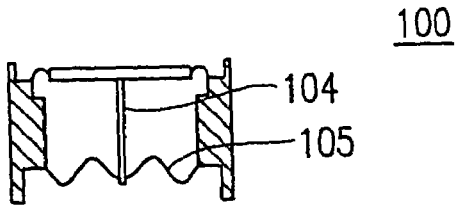
FIG. 1*c* is a cross-sectional view of the speaker 100 taken along line 1*c*—1*c* of FIG. 1*a*.
Figure 1D:
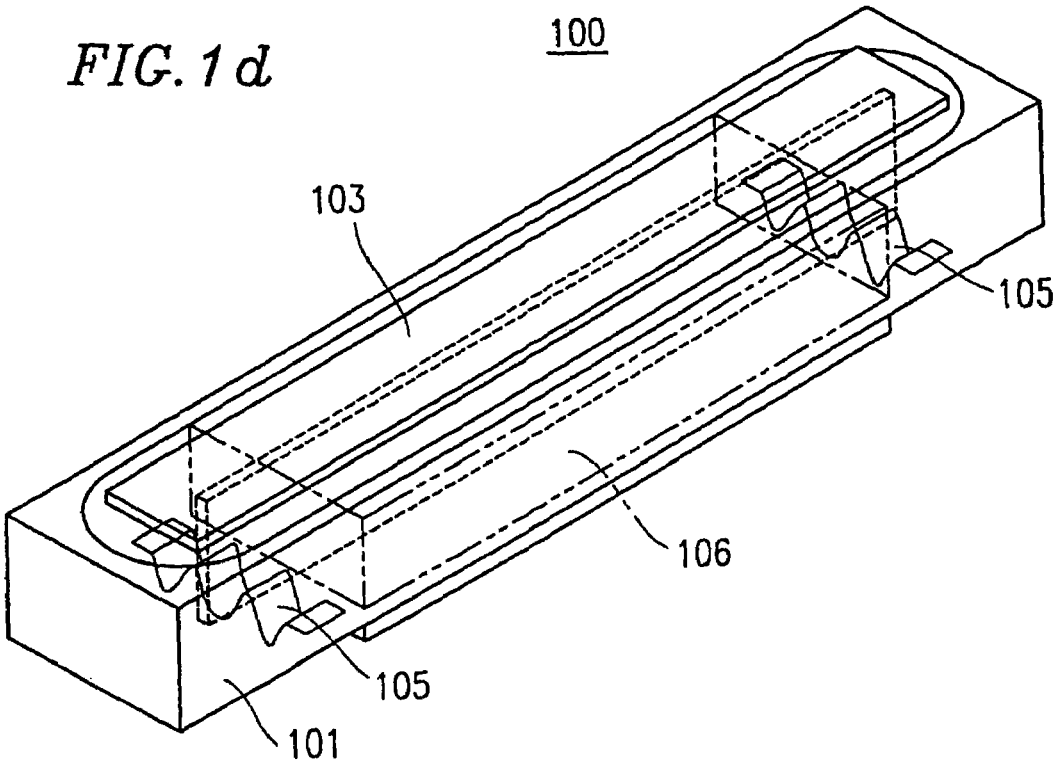
FIG. 1*d* is a perspective view of the speaker 100 according to an embodiment of the present invention.

FIG. 1*a* is a plan view of a speaker 100 according to an embodiment of the present invention. FIG. 1*b* is a cross-sectional view of the speaker 100 taken along line 1*b*—1*b* of FIG. 1*a*. FIG. 1*c* is a cross-sectional view of the speaker 100 taken along line 1*c*—1*c* of FIG. 1*a*. FIG. 1*d* is a perspective view of the speaker 100 according to an embodiment of the present invention.

The speaker 100 includes: a frame 101; a magnetic circuit 106 fixed to the frame 101; a diaphragm 103, which is fixed to the frame 101 such that the diaphragm 103 can vibrate in a direction shown by arrow P of FIG. 1*b*; a driving force transmitting member 104 connected to the diaphragm 103; and dampers 105 for supporting the driving force transmitting member 104. An outer perimeter of the diaphragm 103 is fixed to the frame 101 via an edge 102.

The magnetic circuit 106 is positioned between first and second planes.

In this specification, the "first plane" refers to a plane which is parallel to a diaphragm and with which at least a portion of a magnetic circuit is in contact. The "second plane" refers to another plane which is parallel to a diaphragm and with which at least a portion of a magnetic circuit is in contact.

One end of each damper 105 is connected to the driving force transmitting member 104 at a position between the first and second planes. The other end of each damper 105 is connected to the frame 101 at another position between the first and second planes.

For example, as shown in FIG. 1*d*, if the magnetic circuit 106 has a rectangular parallelepiped shape, and the magnetic circuit 106 is fixed to the frame 101 such that upper face I and lower face II of the magnetic circuit 106 are parallel to the diaphragm 103, the first plane is upper face I of the magnetic circuit 106, and the second plane is lower face II of the magnetic circuit 106.

In such an arrangement of the magnetic circuit 106 and the dampers 105, the positions at which the dampers 105 are attached to the frame 101 are not at a level higher than the upper face of the magnetic circuit 106 nor at a level lower than the lower face of the magnetic circuit 106. As a result, as compared with a conventional speaker wherein dampers are provided above a magnetic circuit, the speaker 100 of the present invention can be formed thinner by at least the thickness of the damper 105.

Further, the speaker 100 can be formed thinner by incorporating the magnetic circuit 106 inside the frame 101. This is because the position at which the magnetic circuit 106 is attached is not at a level higher than the frame 101 nor at a level lower than the frame 101.

In the example shown in FIGS. 1*a* through 1*d*, the magnetic circuit 106 is structured so as to include a magnetic circuit portion 106*a*, another magnetic circuit portion 106*b*, and a magnetic gap 110 which is defined by the magnetic circuit portion 106*a* and the magnetic circuit portion 106*b*.

The magnetic circuit portion 106*a* includes: a magnet 108*a* having a rectangular parallelepiped shape (e.g., rectangular stick); a flat plate 109*a* fixed to an upper surface of the magnet 108*a*: and a flat plate 109*b* fixed to a lower surface of the magnet 108*a*.

The magnetic circuit portion 106*b* includes: a magnet 108*b* having a rectangular parallelepiped shape (e.g., rectangular stick); a flat plate 109*a* fixed to an upper surface of the magnet 108*b*; and a flat plate 109*d* fixed to a lower surface of the magnet 108*b*.

One side surface of the magnetic circuit portion 106*a* is connected onto a flat surface of the frame 101. One side surface of the magnetic circuit portion 106*b* is connected onto a flat surface of the frame 101. The magnet 108*a* and the magnet 108*b* face each other such that facing sides of the magnets 108*a* and 108*b* have opposite polarities.

The magnetic gap 110 includes a magnetic gap 110*a* and a magnetic gap 110*b*.

The magnetic gap 110*a* is a gap which is defined by the plate 109*a* and the plate 109*c* and through which magnetic fluxes generated by the magnet 108*a* and the magnet 108*b* pass. The magnetic gap 110*b* is a gap which is defined by the plate 109*b* and the plate 109*d* and through which magnetic fluxes generated by the magnet 108*a* and the magnet 108*b* pass.

Figure 2:
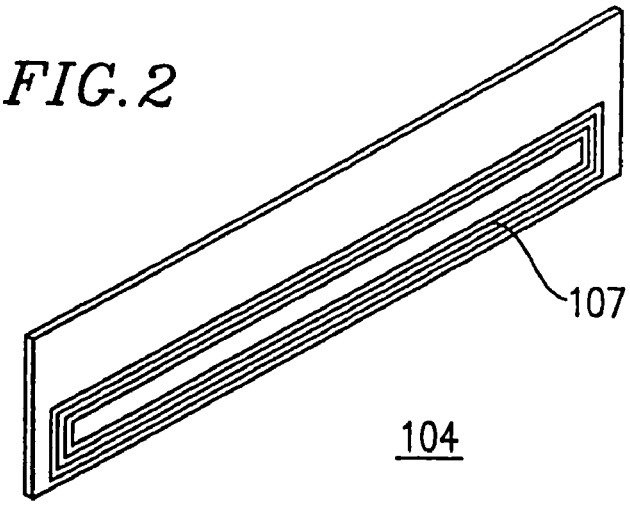
FIG. 2 is a perspective view of a driving force transmitting member 104.

FIG. 2 is a perspective view of the driving force transmitting member 104.

The driving force transmitting member 104 has a region in which voice coils 107 are formed. The driving force transmitting member 104 is incorporated in the speaker 100 such that the region in which the voice coils 107 are formed is placed within the magnetic gap 110.

The voice coils 107 are, for example, thin printed coils looped in the form of a rectangular ring on opposite faces of the driving force transmitting member 104.

When a driving current flows through the voice coil 107, a driving force is produced in a direction shown by arrow P of FIG. 1*b* due to an effect produced by the driving current and a magnetic flux supplied by the magnetic circuit 106. The driving force transmitting member 104 is configured such that the produced driving force is transmitted to the diaphragm 103. This transmitted driving force causes the diaphragm 103 to vibrate in the direction shown by arrow P. As a result, sound is reproduced.

According to the present invention, the shape of the magnetic circuit 106 is not limited to a rectangular parallelepiped shape. The magnetic circuit 106 may be formed into any shape. In such a case also, the speaker 100 can be formed thinner by placing the magnetic circuit 106 and the dampers 105 between the first plane and the second plane.

Based on the above-described configuration, a thin speaker 100 having a length of 65 mm, a width of 14 mm, and a height of 10 mm can be realized. The diaphragm 103 is, for example, an elongated flat plate (longitudinal length: 56 mm: width: 7 mm). The driving force transmitting member 104 is, for example, a flat plate made of glass fiber reinforced resin (thickness: 0.3 mm).

Hereinafter, variations of the present invention are described.

2. Use of a Diaphragm Having a Recessed Portion

The shape of the diaphragm 103 is not limited to a planar shape. The diaphragm 103 may have a recessed portion, into which the driving force transmitting member 104 can be connected.

Figure 3A:
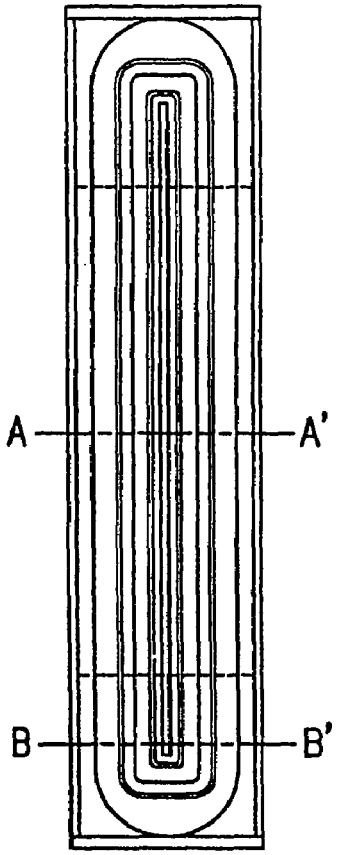
FIG. 3*a* is a plan view of a speaker 100 which incorporates a diaphragm 103*a* having a recessed portion.
Figure 3B:
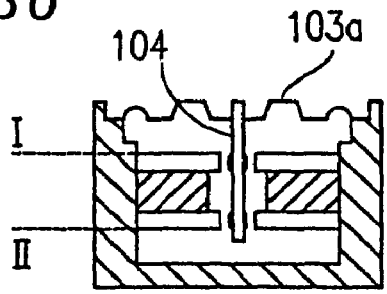
FIG. 3*b* is a cross-sectional view of the speaker 100 shown in FIG. 3*a* taken along line 3*b*—3*b* of FIG. 3*a*.
Figure 3C:
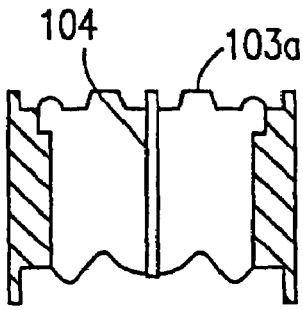
FIG. 3*c* is a cross-sectional view of the speaker 100 shown in FIG. 3*a* taken along line 3*c*—3*c* of FIG. 3*a*.

FIG. 3*a* is a plan view of a speaker 100 which incorporates a diaphragm 103*a* having a recessed portion. FIG. 3*b* is a cross-sectional view of the speaker 100 shown in FIG. 3*a* taken along line 3*b*—3*b* of FIG. 3*a*. FIG. 3*c* is a cross-sectional view of the speaker 100 shown in FIG. 3*a* taken along line 3*c*—3*c* of FIG. 3*a*.

A cross-section of the diaphragm 103*a* has an undulated shape. The diaphragm 103*a* has a recessed portion. The driving force transmitting member 104 is connected into the recessed portion of the diaphragm 103*a*. A slit is formed in the recessed portion of the diaphragm 103*a*. The driving force transmitting member 104 is inserted into the slit, and fixed to the diaphragm 103*a* using an adhesive agent.

In the above-described speaker of the present invention, the driving force transmitting member is adhesively fixed to the recessed portion of the vibrating plate. Thus, the adhesive agent puddles in the recessed portion, so that a speaker having a strong connection between elements can be obtained.

3. Use of a Frame Having a Recessed Portion

It is not indispensable that one side surface of the magnetic circuit portion 106 is connected onto a flat surface of the frame 101. The frame may have a recessed portion, and at least a portion of the magnetic circuit may be buried in the recessed portion. Further, it is not indispensable that the four frame plates of the frame 101 are produced as one piece element. The frame 101 may be produced by assembling four frame plates.

Figure 4A:
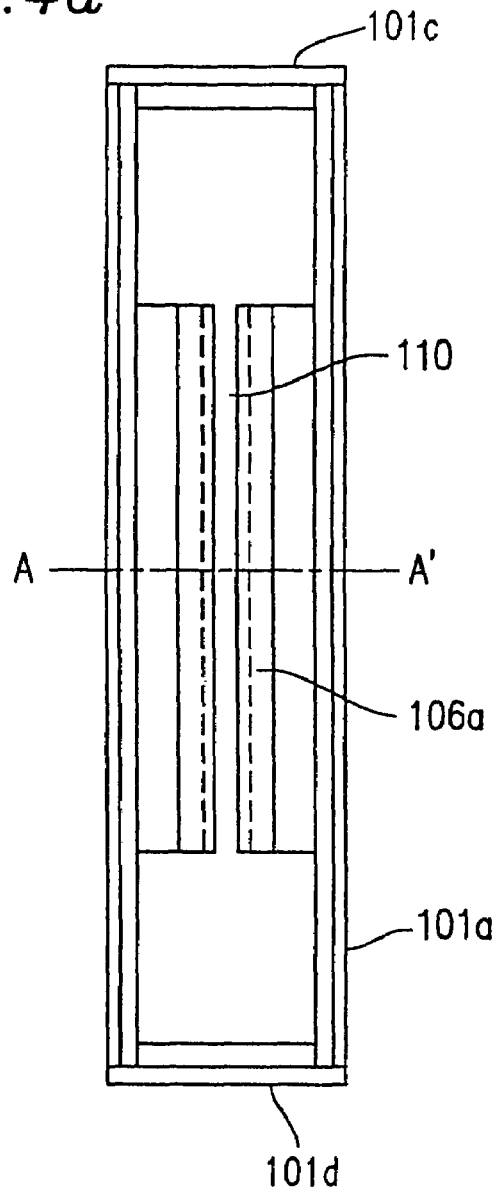
FIG. 4*a* is a plan view of a speaker 100 which incorporates frame plates 101*a* and 101*b* each having a recessed portion.
Figure 4B:
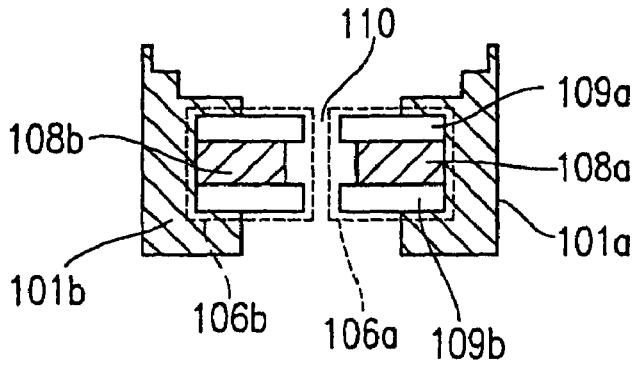
FIG. 4*b* is a cross-sectional view of the speaker 100 shown in FIG. 4*a* taken along line 4*b*—4*b* of FIG. 4*a*.
Figure 4C:
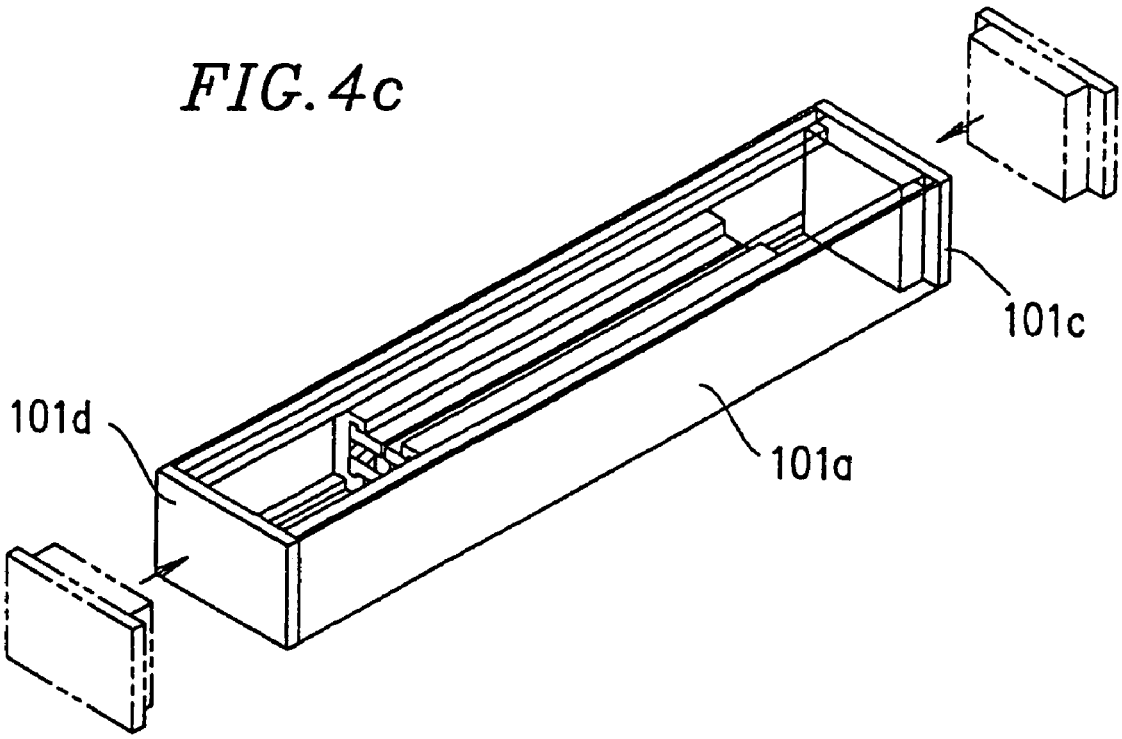
FIG. 4*c* is a perspective view of the speaker 100 shown in FIG. 4*a*.

FIG. 4*a* is a plan view of a speaker 100 which incorporates frame plates 101*a* and 101*b* each having a recessed portion. FIG. 4*b* is a cross-sectional view of the speaker 100 shown in FIG. 4*a* taken along line 4*b*—4*b* of FIG. 4*a*. FIG. 4*c* is a perspective view of the speaker 100 shown in FIG. 4*a*.

The magnetic circuit 106 includes a magnetic circuit portion 106*a* and a magnetic circuit portion 106*b*.

The frame 101 includes: a frame plate 110*a* to which the magnetic circuit portion 106*a* is fixed; a frame plate 101*b* to which the magnetic circuit portion 106*b* is fixed; a frame plate 101*c*; and a frame plate 101*d*.

As shown in FIG. 4*c*, one side of the frame plate 101*c* is connected to one end side of the frame plate 101*a*. The opposite side of the frame plate 101*a* is connected to one end side of the frame plate 101*b*.

As shown in FIG. 4*c*, one side of the frame plate 101*d* is connected to the other end side of the frame plate 101*a*. The opposite side of the frame plate 101*d* is connected to the other end side of the frame plate 101*b*.

The frame plate 101*a* has a recessed portion. A portion of the magnetic circuit portion 106*a* is buried in the recessed portion of the frame plate 101*a*. The frame plate 101*b* has a recessed portion. A portion of the magnetic circuit portion 106*b* is buried in the recessed portion of the frame plate 101*b*.

Since the magnet 108*a* and the magnet 108*b* face each other such that facing sides of the magnets 108*a* and 108*b* have opposite polarities, strong attractive force (magnetic attractive force) is constantly present between the magnet 108*a* and the magnet 108*b*, so that the magnet 108*a* and the magnet 108*b* constantly attract each other. Further, the shape of the speaker 100 may be deformed by heat.

In the above-described speaker of the present invention, since a large adhesion area can be secured between the magnetic circuit portion 106*a* and the frame plate 101*a*, a high adhesion strength can be obtained therebetween. Since a large adhesion area can be secured between the magnetic circuit portion 106*b* and the frame plate 101*b*, a high adhesion strength can be obtained therebetween. Thus, a risk of detachment of the magnetic circuit portion 106*a* from the frame plate 101*a* due to magnetic attractive force or thermal deformation is greatly reduced.

Furthermore, in the above-described speaker of the present invention, since a frame is produced by assembling four frame plates, the magnetic circuit can be readily produced and assembled.

4. Use of a Magnetic Circuit Having a Protrusion

The shapes of upper and lower surfaces of the magnetic circuit 106 are not limited to a planar shape. The upper surface or lower surface of the magnetic circuit 106 may have a protrusion, and the frame 101 may have a portion which connects to the protrusion of the magnetic circuit 106.

Figure 5A:
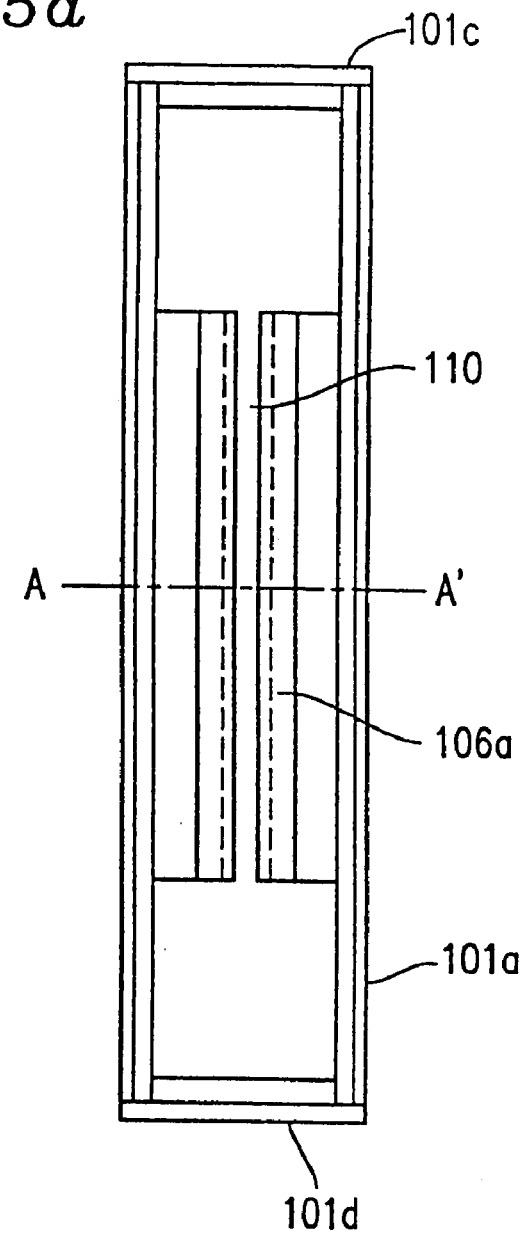
FIG. 5*a* is a plan view of a speaker 100 which incorporates a magnetic circuit having a protrusion.
Figure 5B:
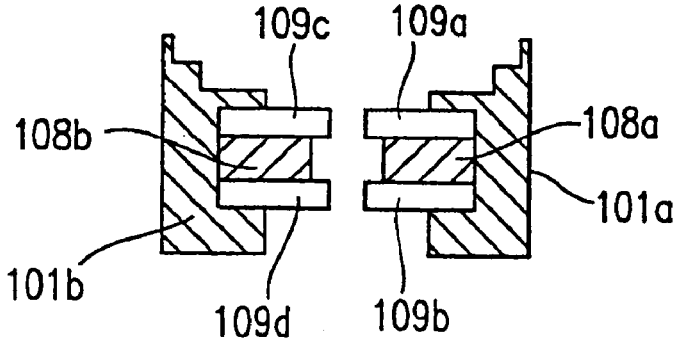
FIG. 5*b* is a cross-sectional view of the speaker 100 shown in FIG. 5*a* taken along line 5*b*—5*b* of FIG. 5*a*.
Figure 5C:
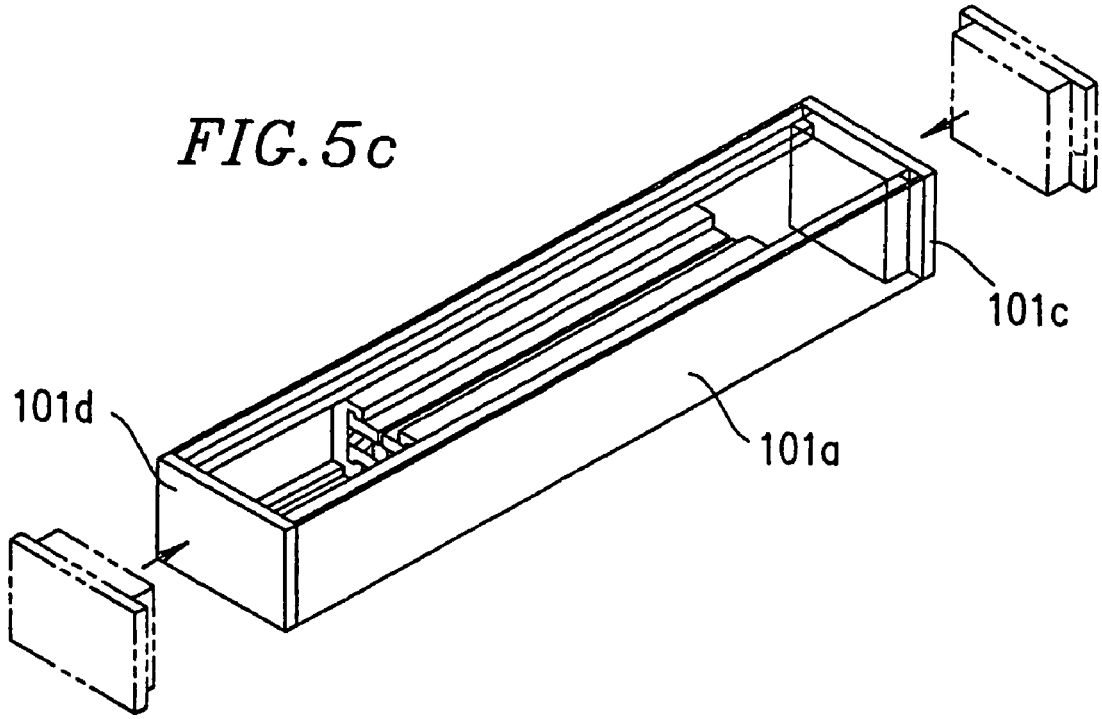
FIG. 5*c* is a perspective view of the speaker 100 shown in FIG. 5*a*.

FIG. 5*a* is a plan view of a speaker 100 which incorporates a magnetic circuit having a protrusion. FIG. 5*b* is a cross-sectional view of the speaker 100 shown in FIG. 5*a* taken along line 5*b*—5*b* of FIG. 5*a*. FIG. 5*c* is a perspective view of the speaker 100 shown in FIG. 5*a*.

The plate 109*a*, which is fixed onto the upper surface of the magnet 108*a*, has a protrusion. The frame 101 has a portion which connects to the protrusion of the plate 109*a*. The plate 109*b*, which is fixed onto the lower surface of the magnet 108*a*, has a protrusion. The frame 101 has a portion which connects to the protrusion of the plate 109*b*. The plate 109*c*, which is fixed onto the upper surface of the magnet 108*b*, has a protrusion. The frame 101 has a portion which connects to the protrusion of the plate 109*c*. The plate 109*d*, which is fixed onto the lower surface of the magnet 108*b*, has a protrusion. The frame 101 has a portion which connects to the protrusion of the plate 109*d*.

Since the magnet 108*a* and the magnet 108*b* face each other such that facing sides of the magnets 108*a* and 108*b* have opposite polarities, strong attractive force (magnetic attractive force) is constantly present between the magnet 108*a* and the magnet 108*b*, so that the magnet 108*a* and the magnet 108*b* constantly attract each other. Further, the shape of the speaker 100 may be deformed by heat.

In the above-described speaker of the present invention, since a large adhesion area can be secured between the magnetic circuit portion 106*a* and the frame plate 101*a*, a high adhesion strength can be obtained therebetween. Since a large adhesion area can be secured between the magnetic circuit portion 106*b* and the frame plate 101*b*, a high adhesion strength can be obtained therebetween. Thus, a risk of detachment of the magnetic circuit portion 106*a* from the frame plate 101*a* due to magnetic attractive force or thermal deformation is greatly reduced.

5. Use of a Frame Having a Bottom Plate

The structure of the frame 101 is not limited to a four-plate structure (frame plates 101*a* to 101*d*). The frame 101 may further include a bottom plate 101*e*.

Figure 6A:
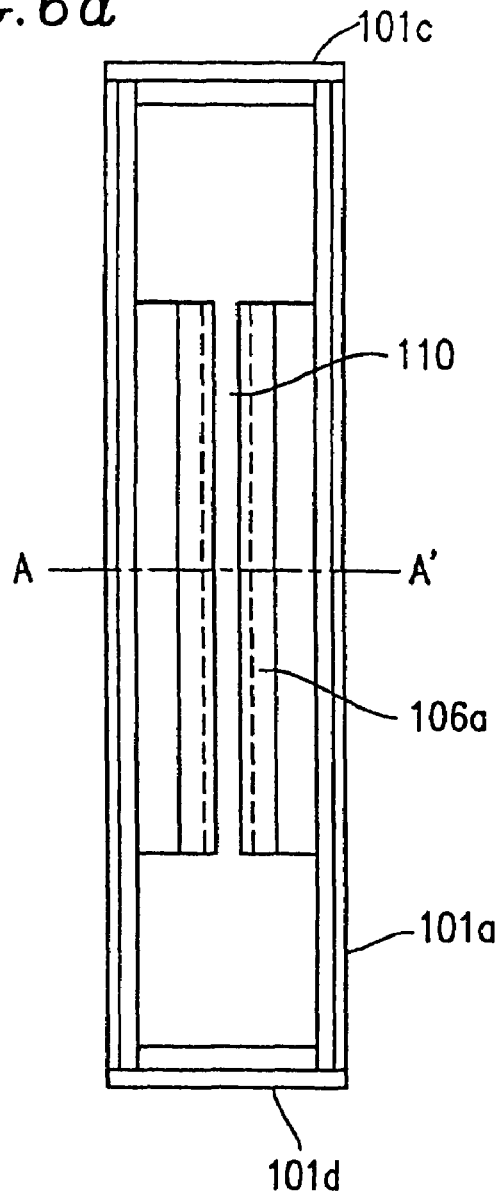
FIG. 6*a* is a plan view of a speaker 100 which incorporates the bottom plate 101*e*.
Figure 6B:
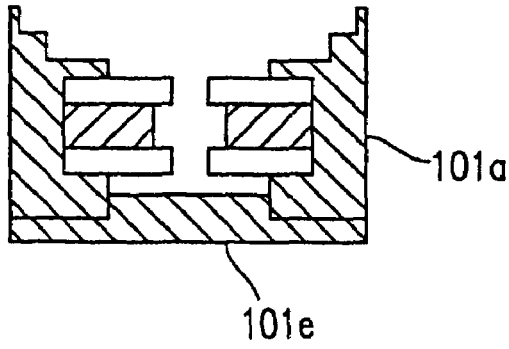
FIG. 6*b* is a cross-sectional view of the speaker 100 shown in FIG. 6*a* taken along line 6*b*—6*b* of FIG. 6*a*.
Figure 6C:
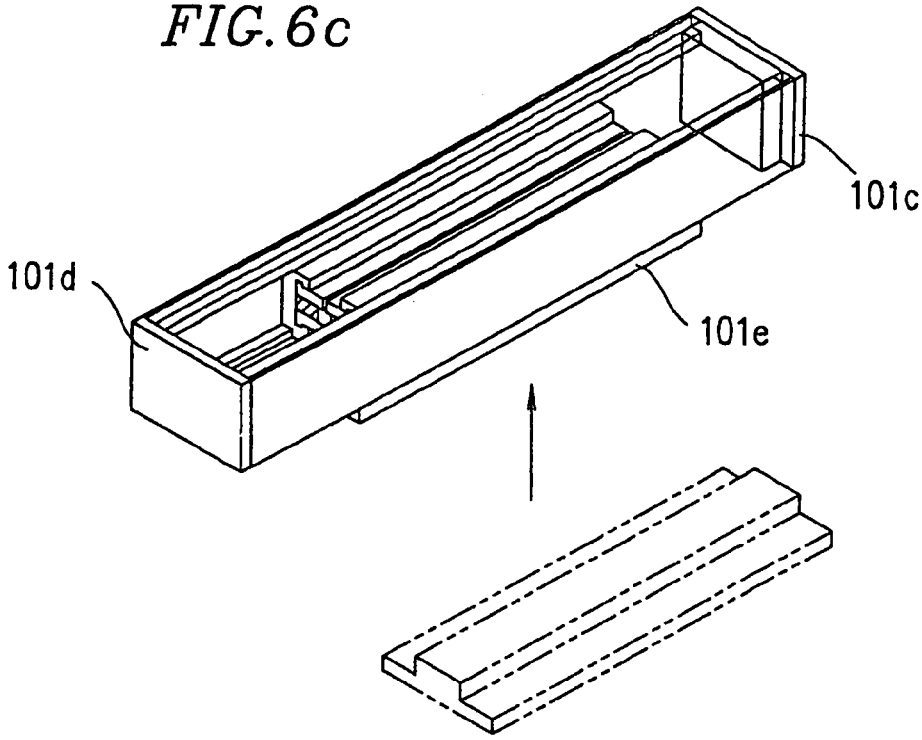
FIG. 6*c* is a perspective view of the speaker 100 shown in FIG. 6*a*.

FIG. 6*a* is a plan view of a speaker 100 which incorporates the bottom plate 101*e*. FIG. 6*b* is a cross-sectional view of the speaker 100 shown in FIG. 6*a* taken along line 6*b*—6*b* of FIG. 6*a*. FIG. 6*c* is a perspective view of the speaker 100 shown in FIG. 6*a*.

With the frame 101 produced by assembling five plates which include the bottom plate 101*e*, the strength of the structure of the speaker 100 can be further improved.

6. Use of a Driving Force Transmitting Member Having a Through Hole

The driving force transmitting member 104 may have a through hole outside of a region in which the voice coil 107 is formed.

Figure 7:
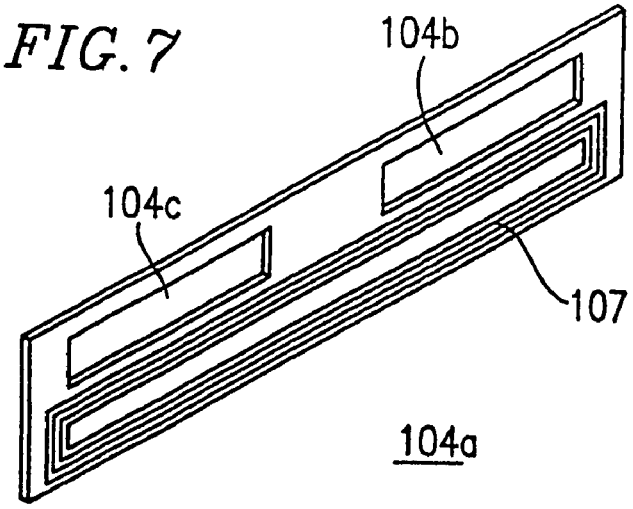
FIG. 7 is a perspective view of a driving force transmitting member 104*a* having a through hole.

FIG. 7 is a perspective view of a driving force transmitting member 104*a* having a through hole.

The driving force transmitting member 104*a* has a through hole 104*b* and a through hole 104*c*. The size of each of the through holes 104*b* and 104*c* is, for example, a width of 16 mm and a height of 2 mm.

The through holes 104*b* and 104*c* are formed in the driving force transmitting member 104*a* in such a manner that driving force transmission efficiency is not reduced. Since the weight of the driving force transmitting member 104*a* is reduced, a driving efficiency of the speaker 100 is improved.

7. Use of a Driving Force Transmitting Member Formed by a Composite Plate

The structure of the driving force transmitting member 104*a* is not limited to a single plate structure. The driving force transmitting member 104*a* may be formed by a composite plate.

Figure 8:
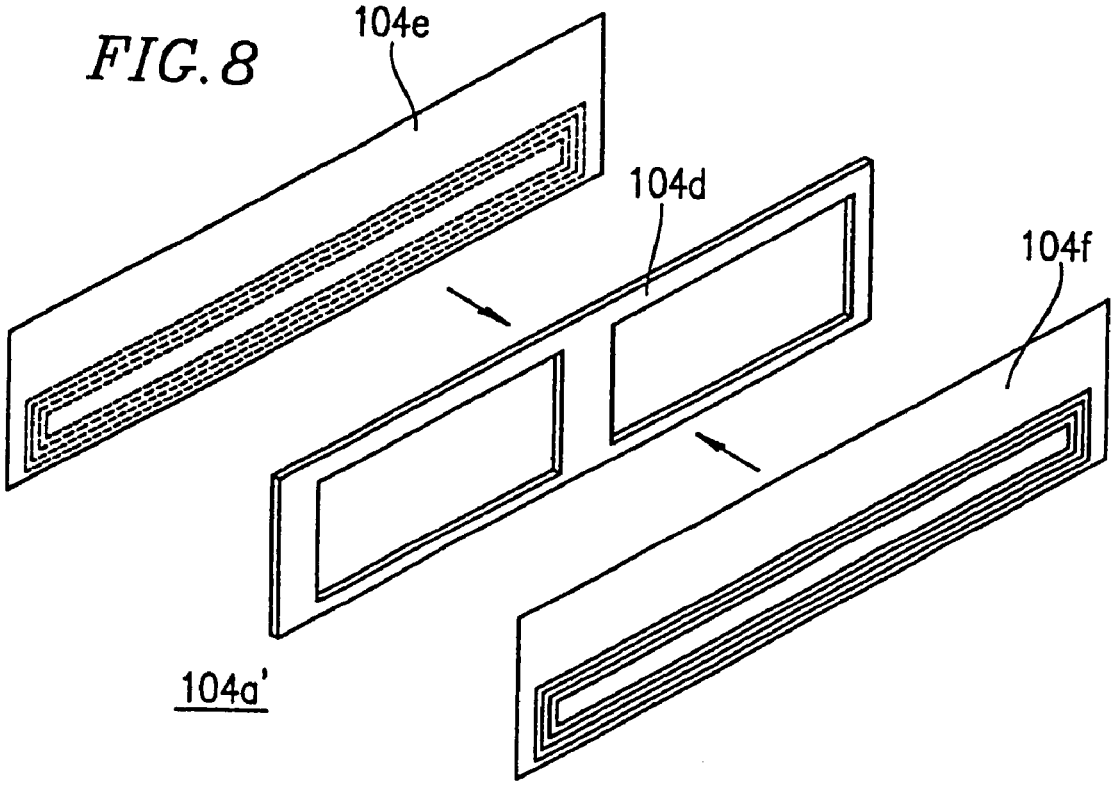
FIG. 8 is a perspective view of a driving force transmitting member 104*a*' formed by a composite plate.

FIG. 8 is a perspective view of a driving force transmitting member 104*a*' formed by a composite plate.

The driving force transmitting member 104*a*' is formed by combining a core member 104*d* having at least one through hole, a surface member 104*e* having a region in which a voice coil 107 is formed, and a surface member 104*f* having a region in which another voice coil 107 is formed.

The surface members 104*e* and 104*f* is, for example, a sheet made of glass fiber composite resin.

The driving force transmitting member 104*a*' is formed by a composite plate including light-weight members and a core member having high rigidity. Therefore, as compared with a single-plate structure, a lighter and highly-rigid driving force transmitting member can be obtained.

8. Use of a Magnetic Circuit Having a Single Magnet

The structure of the magnetic circuit is not limited to use of two magnets. The number of magnets used in the magnetic circuit may be one.

Figure 9A:
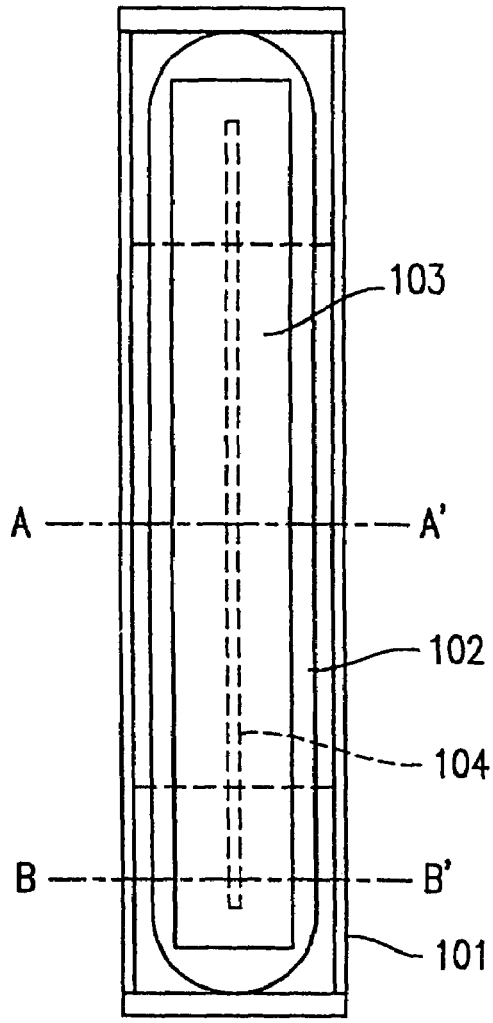
FIG. 9*a* is a plan view of a speaker 100 which incorporates a magnetic circuit having a single magnet.
Figure 9B:
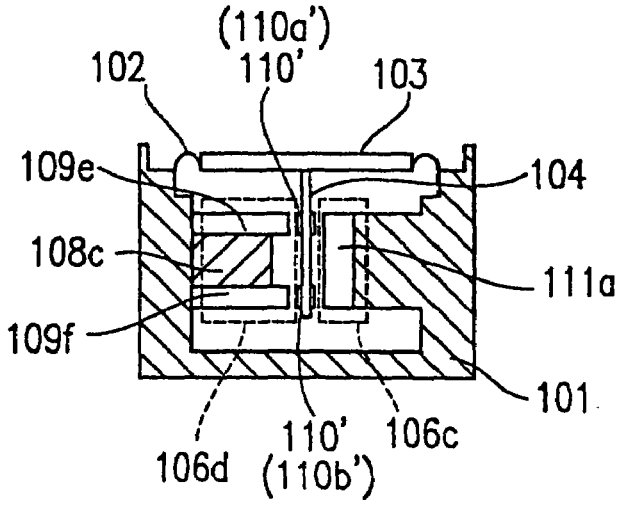
FIG. 9*b* is a cross-sectional view of the speaker 100 shown in FIG. 9*a* taken along line 9*b*—9*b* of FIG. 9*a*.
Figure 9C:
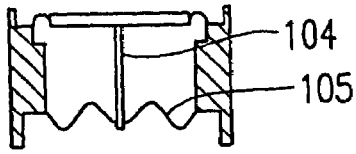
FIG. 9*c* is a cross-sectional view of the speaker 100 shown in FIG. 9*a* taken along line 9*c*—9*c* of FIG. 9*a*.
Figure 9D:
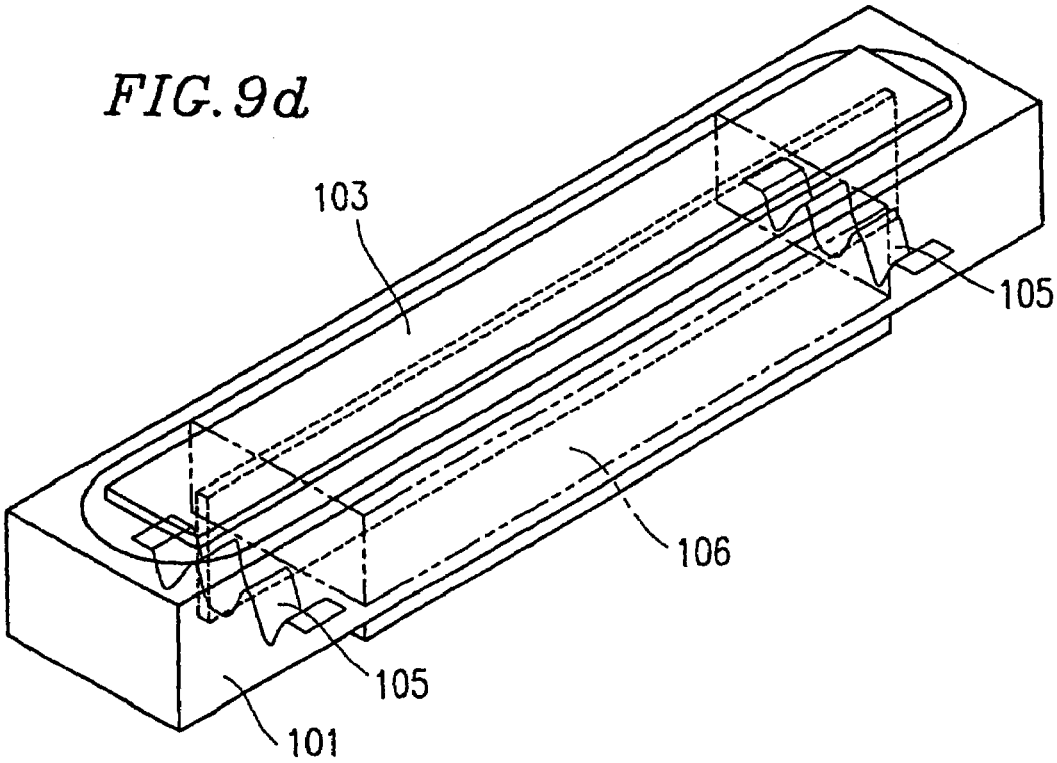
FIG. 9*d* is a perspective view of the speaker 100 shown in FIG. 9*a*.

FIG. 9*a* is a plan view of a speaker 100 which incorporates a magnetic circuit having a single magnet. FIG. 9*b* is a cross-sectional view of the speaker 100 shown in FIG. 9*a* taken along line 9*b*—9*b* of FIG. 9*a*. FIG. 9*c* is a cross-sectional view of the speaker 100 shown in FIG. 9*a* taken along line 9*c*–9*c* of FIG. 9*a*. FIG. 9*d* is a perspective view of the speaker 100 shown in FIG. 9*a*.

The magnetic circuit 106 is structured so as to include a magnetic circuit portion 106*c*, another magnetic circuit portion 106*d*, and a magnetic gap 110' which is defined by the magnetic circuit portion 106*c* and the magnetic circuit portion 106*d*.

The magnetic circuit portion 106*c* includes: a magnet 108*c* having a rectangular parallelepiped shape (e.g., rectangular stick); a plate 109*e* fixed to an upper surface of the magnet 108*c*; and a flat plate 109*f* fixed to a lower surface of the magnet 108*c*.

The magnetic circuit portion 106*d* includes a yoke 111*a*.

One side surface of the magnetic circuit portion 106*c* is connected to the frame 101. One side surface of the magnetic circuit portion 106*d* is connected to the frame 101. The magnet 108*c* and the yoke 111*a* face each other.

The magnetic gap 110 includes a magnetic gap 110*a*' and a magnetic gap 110*b*'. The magnetic gap 110*a*' is defined by the plate 109*e* and the yoke 111*a*. A magnetic flux generated by the magnet 108*c* passes through the magnetic gap 110*a*'. The magnetic gap 110*b*' is defined by the plate 109*f* and the yoke 111*a*. The magnetic flux generated by the magnet 108*a* passes through the magnetic gap 110*b*'.

The magnetic flux generated by the magnet 108*c* is transmitted through the plate 109*e*, and passes through the magnetic gap 110*a*' so as to reach the yoke 111*a*.

The magnetic circuit portion 106*d* includes the yoke 111*a* in place of one magnet and two plates. Thus, the cost of the speaker 100 can be reduced. It should be noted that the present invention is not limited to any specific position to which the damper is attached. For example, the position to which the damper is attached may be at a level higher than the upper surface of the magnetic circuit. Alternatively, the position to which the damper is attached may be at a level lower than the lower surface of the magnetic circuit. When the magnetic circuit portion 106*d* includes the yoke 111*a* in place of one magnet and two plates, the cost of the speaker 100 can be reduced.

A portion of the plate 109*e* may be in contact with the yoke 111*a* which faces the plate 109*e*. A portion of the plate 109*f* may be in contact with the yoke 111*a* which faces the plate 109*e*.

Figure 10A:
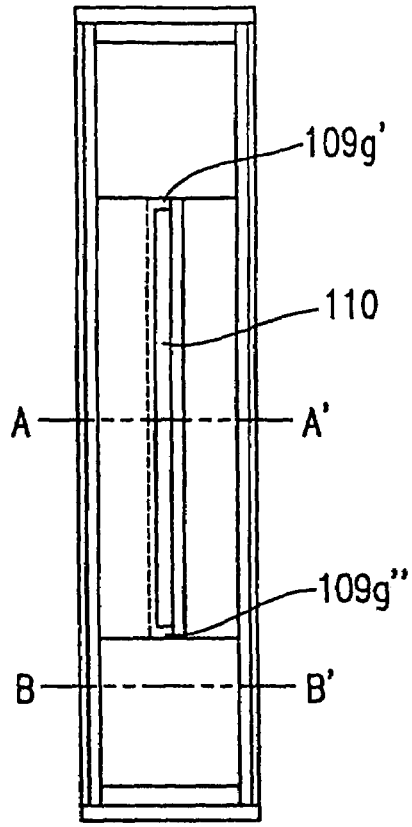
FIG. 10*a* is a plan view of a speaker wherein a portion of a plate is in contact with a yoke which faces the plate.
Figure 10B:
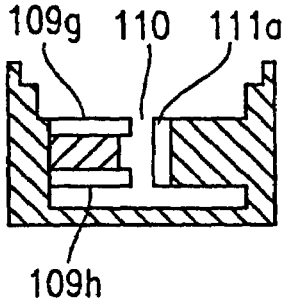
FIG. 10*b* is a cross-sectional view of the speaker shown in FIG. 10*a* taken along line 10*b*—10*b* of FIG. 10*a*.
Figure 10C:
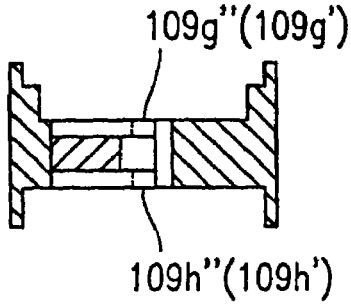
FIG. 10*c* is a cross-sectional view of the speaker 100 shown in FIG. 10*a* taken along line 10*c*—10*c* of FIG. 10*a*.

FIG. 10*a* is a plan view of a speaker wherein a portion of a plate is in contact with a yoke which faces the plate. FIG. 10*b* is a cross-sectional view of the speaker shown in FIG. 10*a* taken along line 10*b*—10*b* of FIG. 10*a*. FIG. 10*c* is a cross-sectional view of the speaker 100 shown in FIG. 10*a* taken along line 10*c*—10*c* of FIG. 10*a*.

A plate 109*g*, which is fixed to an upper surface of the magnet 108*c*, includes an extended portion 109*g*' and an extended portion 109*g*″. The extended portions 109*g*' and 109*g*' are in contact with the yoke 111*a*. A plate 109*h*, which is fixed to a lower surface of the magnet 108*c*, includes an extended portion 109*h*' and an extended portion 109*h*″. The extended portions 109*h*' and 109*h*" are in contact with the yoke 111*a*. A cross-section of each of the extended portions 109*g*', 109*g*", 109*h*', and 109*h*″ has an area such that a magnetic flux is saturated, i.e., a magnetic flux cannot be transmitted through the extended portions 109*g*', 109*g*″, 109*h*', and 109*h*". Thus, substantially no magnetic flux passes through the plate 109*g*, the extended portions 109*g*', 109*g*", and the yoke 111*a*. Thus, reduction of the magnetic flux density in a magnetic gap is prevented, and the magnetic gap can be securely maintained.

It should be noted that the present invention is not limited to any specific position to which the damper is attached. For example, the position to which the damper is attached may be at a level higher than the upper surface of the magnetic circuit. Alternatively, the position to which the damper is attached may be at a level lower than the lower surface of the magnetic circuit. When a portion of the plate 109*e* is in contact with the yoke 111*a* which faces the plate 109*e*, or when a portion of the plate 109*f* is in contact with the yoke 111*a* which faces the plate 109*f*, reduction of the magnetic flux density in a magnetic gap is prevented, and the magnetic gap can be securely maintained.

9. Use of a Magnetic Circuit Having Magnetic Circuit Portion Where Two Magnets Are Vertically Aligned The structure of the magnetic circuit is not limited to two horizontally aligned magnets. The structure of the magnetic circuit may employ an arrangement where two magnets are vertically aligned, i.e., aligned along a direction of vibration of the diaphragm.

Figure 11A:
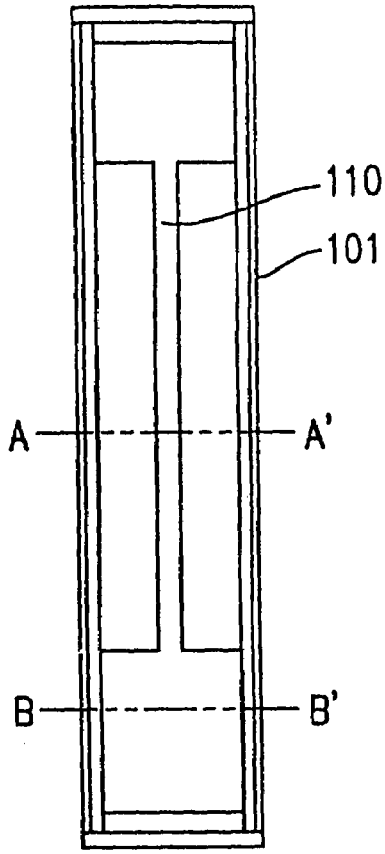
FIG. 11*a* is a plan view of a speaker which incorporates a magnetic circuit having a magnetic circuit portion where magnets are vertically aligned.
Figure 11B:
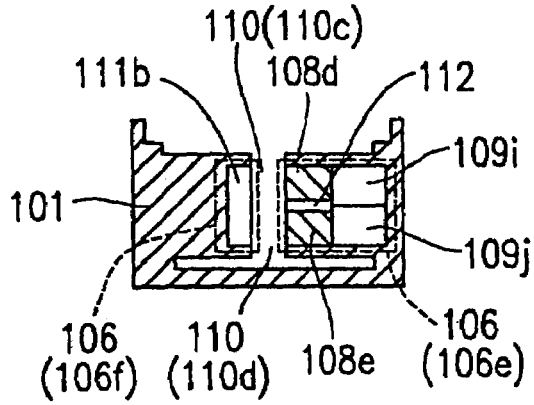
FIG. 11*b* is a cross-sectional view of the speaker shown in FIG. 11*a* taken along line 11*b*—11*b* of FIG. 11*a*.
Figure 11C:
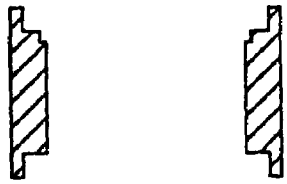
FIG. 11*c* is a cross-sectional view of the speaker shown in FIG. 11*a* taken along line 11*c*—11*c* of FIG. 11*a*.
Figure 12A:
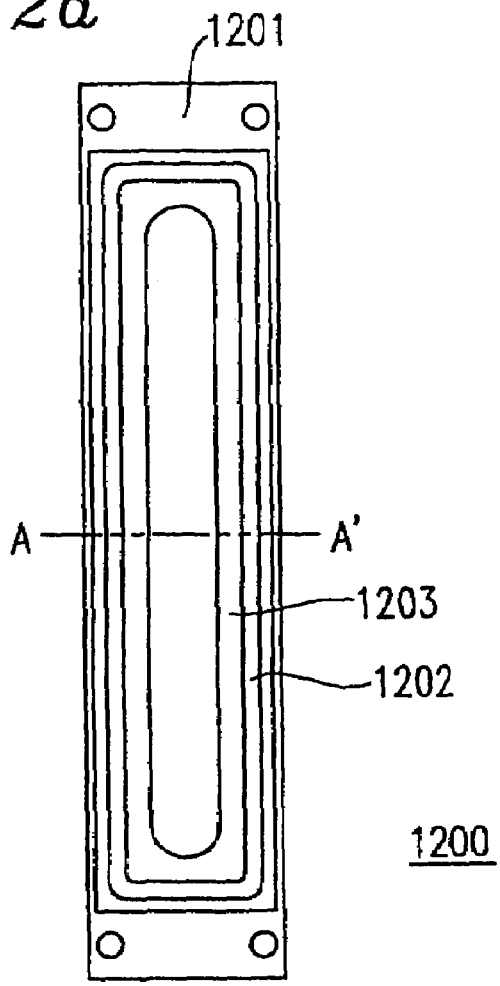
FIG. 12*a* is a plan view of the conventional speaker 1200.
Figure 12B:
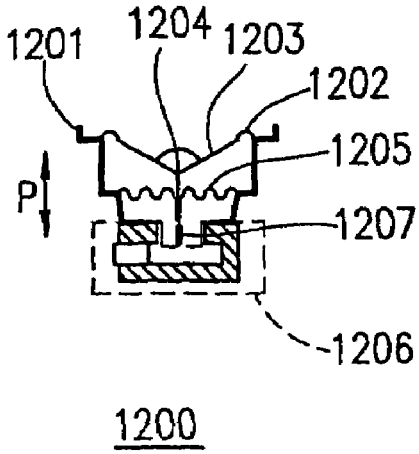
FIG. 12*b* is a cross-sectional view of the conventional speaker 1200 taken along line 12*b*—12*b* of FIG. 12*a*.

FIG. 11*a* is a plan view of a speaker which incorporates a magnetic circuit having a magnetic circuit portion where magnets are vertically aligned. FIG. 11*b* is a cross-sectional view of the speaker shown in FIG. 11*a* taken along line 11*b*—11*b* of FIG. 11*a*. FIG. 11*c* is a cross-sectional view of the speaker shown in FIG. 11*a* taken along line 11*c*—11*c* of FIG. 11*a*.

The magnetic circuit 106 is structured so as to include a magnetic circuit portion 106*e*, another magnetic circuit portion 106*f*, and a magnetic gap 110 which is defined by the magnetic circuit portion 106*e* and the magnetic circuit portion 106*f*.

The magnetic circuit portion 106*e* includes: a magnet 108*d* having a rectangular parallelepiped shape; a magnet 108*e* having a rectangular parallelepiped shape; a plate 109*i*, and a plate 109*i*. The magnetic circuit portion 106*f* includes a yoke 111*b*.

A side of the plate 109*i* is connected to the frame 101. The opposite side of the plate 109*i* is connected to the magnet 108*d*. A side of the plate 109*j* is connected to the frame 101. The opposite side of the plate 109*j* is connected to the magnet 108*e*.

The magnet 108*d* and the yoke 111*b* face each other. The magnet 108*e* and the yoke 111*b* face each other. The magnet 108*d* and the magnet 108*e* are vertically aligned and fixed such that facing sides of the magnets 108*d* and 108*e* have opposite polarities.

The magnetic gap 110 includes a magnetic gap 110*c* and a magnetic gap 110*d*.

The magnetic gap 10*c* is defined by the plate 109*i* and the yoke 111*b*. A magnetic flux generated by the magnet 108*d* passes through the magnetic gap 110*c*. The magnetic gap 110*d* is defined by the plate 109*j* and the yoke 111*b*. A magnetic flux generated by the magnet 108*e* passes through the magnetic gap 110*d*.

Between the magnet 108*d* and the magnet 108*e*, a spacer 112 formed by a plate of aluminum, which is a non-magnetic material, is provided. An undesirable flow of a magnetic flux between the magnets 108*d* and 108*e* is thereby prevented by the spacer 112.

A magnetic flux which comes out from the N-pole of the magnet 108*d* passes through the magnetic gap 110*c*, so as to enter the yoke 111*b* which faces the magnet 108*d*. The magnetic flux comes out from a lower surface of the yoke 111*b*, and passes through the magnetic gap 110*d*, so as to enter the S-pole of the magnet 108*e* which faces the magnet 108*d*. Furthermore, the magnetic flux comes out from the N-pole of the magnet 108*e*, and is transmitted through the plate 109*j* and the plate 109*i*, so as to reach the S-pole of the magnet 108*d*. In this way, a closed loop of a magnetic flux is generated. Thus, in the magnetic gap 110*d*, a magnetic flux advances in a direction from the yoke 111*b* to the magnet 108*e*.

With an arrangement where the magnet 108*d* and the magnet 108*e* are vertically aligned along a direction of vibration of the diaphragm, a larger, high magnetic flux density area can be obtained above and below the magnetic gap 110, as compared with an arrangement where the magnets are horizontally aligned. Thus, a variation in the magnetic density which is caused when the voice coil 107 vertically vibrates is small. Accordingly, a variation in the driving force is small. Therefore, a speaker, wherein lineality of an input vs. reproduction sound pressure characteristic is excellent, reproduction quality of a low sound range is excellent, and sound distortion is reduced, is realized.

It should be noted that the present invention is not limited to any specific position to which the damper is attached. For example, the position to which the damper is attached may be at a level higher than the upper surface of the magnetic circuit. Alternatively, the position to which the damper is attached may be at a level lower than the lower surface of the magnetic circuit. When the magnet 108*d* and the magnet 108*e* are vertically aligned along a direction of vibration of the diaphragm, a speaker, wherein lineality of an input vs. reproduction sound pressure characteristic is excellent, reproduction quality of a low sound range is excellent, and sound distortion is reduced, is realized.

In a speaker according to the present invention, a magnetic circuit is positioned between first and second planes which are parallel to a diaphragm. One end of a damper is connected to a driving force transmitting member at a position between the first and second planes. The other end of the damper is connected to a frame at another position between the first and second planes. In such a configuration, the positions at which the damper is attached to the frame are not at a level higher than the upper face of the magnetic circuit nor at a level lower than the lower face of the magnetic circuit. As a result, the speaker achieved according to the present invention is thinner by at least the thickness of the damper as compared with a conventional speaker wherein a damper is provided above a magnetic circuit.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A speaker, comprising:

a frame;

a magnetic circuit fixed to the frame;

a diaphragm fixed to the frame so as to be capable of vibrating in a predetermined direction;

a driving force transmitting member connected to the diaphragm; and a damper for supporting the driving force transmitting member, wherein the magnetic circuit is positioned between a first plane and a second plane, the first plane being parallel to the diaphragm and defined as a plane with which at least a portion of the magnetic circuit is in contact, and the second plane being parallel to the diaphragm and defined as a plane with which at least a portion of the magnetic circuit is in contact, the driving force transmitting member has a region in which a voice coil is formed, the driving force transmitting member is structured so as to transmit to the diaphragm, a driving force, in the predetermined direction, caused by an effect of an electric current flowing through the voice coil and a magnetic flux generated from the magnetic circuit, the magnetic circuit includes a first magnetic circuit portion, a second magnetic circuit portion, and a magnetic gap defined by the first and second magnetic circuit portions, the first magnetic circuit portion includes a magnet having a rectangular parallelepiped shape, a first plate fixed onto an upper surface of the magnet, and a second plate fixed onto a lower surface of the magnet, the second magnetic circuit portion includes a yoke, a side surface of the first magnetic circuit portion is connected onto the frame, a side surface of the second magnetic circuit portion is connected onto the frame, the magnet and the yoke face each other, and the magnetic gap includes a first magnetic gap, which is defined by the first plate and the yoke and through which the magnetic flux generated by the magnet passes, and a second magnetic gap, which is defined by the second plate and the yoke and through which the magnetic flux generated by the magnet passes.

2. A speaker according to claim 1, wherein at least a portion of the first plate is in contact with the yoke which faces the first plate, and at least a portion of the second plate is in contact with the yoke which faces the second plate.

3. A speaker, comprising:

a frame;

a magnetic circuit fixed to the frame;

a diaphragm fixed to the frame so as to be capable of vibrating in a predetermined direction;

a driving force transmitting member connected to the diaphragm; and a damper for supporting the driving force transmitting member, wherein the magnetic circuit is positioned between a first plane and a second plane, the first plane being parallel to the diaphragm and defined as a plane with which at least a portion of the magnetic circuit is in contact, and the second plane being parallel to the diaphragm and defined as a plane with which at least a portion of the magnetic circuit is in contact, the driving force transmitting member has a region in which a voice coil is formed, the driving force transmitting member is structured so as to transmit to the diaphragm, a driving force, in the predetermined direction, caused by an effect of an electric current flowing through the voice coil and a magnetic flux generated from the magnetic circuit, the magnetic circuit includes a first magnetic circuit portion, a second magnetic circuit portion, a second magnetic circuit portion, and a magnetic gap defined by the first and second magnetic circuit portions, the first magnetic circuit portion includes a first magnet having a rectangular parallelepiped shape, a second magnet having a rectangular parallelepiped shape, a first plate and a second plate, the second magnetic circuit portion includes a yoke, a side surface of the first plate is connected onto the frame, the opposite side surface of the first plate is connected onto the first magnet, a side surface of the second plate is connected onto the frame, the opposite side surface of the second plate is connected onto the second magnet, the first magnet and the yoke face each other, and the second magnet and the yoke face each other, the first and second magnets are aligned along a predetermined direction such that facing sides thereof having opposite polarities, and the magnetic gap includes a first magnetic gap, which is defined by the first plate and the yoke and through which the magnetic flux generated by the first magnet passes, and a second magnetic gap, which is defined by the second plate and the yoke and through which the magnetic flux generated by the second magnet passes.

* * * * *

UNITED STATES PATENT AND TRADEMARK OFFICE

CERTIFICATE OF CORRECTION

PATENT NO. : 6,973,194 B2
APPLICATION NO. : 10/760893
DATED : January 20, 2004
INVENTOR(S) : Mikio Iwasa et al.

It is certified that error appears in the above-identified patent and that said Letters Patent is hereby corrected as shown below:

Column 14,
Lines 41 and 42, "a second magnetic circuit portion" (wording duplicated)

Signed and Sealed this

Eleventh Day of July, 2006

JON W. DUDAS
*Director of the United States Patent and Trademark Office*

UNITED STATES PATENT AND TRADEMARK OFFICE

CERTIFICATE OF CORRECTION

PATENT NO. : 6,973,194 B2
APPLICATION NO. : 10/760893
DATED : December 6, 2005
INVENTOR(S) : Mikio Iwasa et al.

It is certified that error appears in the above-identified patent and that said Letters Patent is hereby corrected as shown below:

Column 14,
Lines 41 and 42, "a second magnetic circuit portion" (wording duplicated)

This certificate supersedes certificate of correction issued July 11, 2006.

Signed and Sealed this

Eighth Day of August, 2006

JON W. DUDAS
*Director of the United States Patent and Trademark Office*